US005215603A

United States Patent [19]

Nakayama et al.

[11] Patent Number: 5,215,603

[45] Date of Patent: Jun. 1, 1993

[54] METHOD OF PRIMARY RECRYSTALLIZATION ANNEALING GRAIN-ORIENTED ELECTRICAL STEEL STRIP

[75] Inventors: Tadashi Nakayama; Yasunari Yoshitomi, both of Kitakyusyushi, Japan

[73] Assignee: Nippon Steel Corporation, Tokyo, Japan

[21] Appl. No.: 734,294

[22] Filed: Jul. 17, 1991

Related U.S. Application Data

[63] Continuation-in-part of Ser. No. 663,205, Feb. 28, 1991, abandoned, which is a continuation of Ser. No. 461,123, Jan. 4, 1990, abandoned.

[30] Foreign Application Priority Data

Apr. 5, 1989 [JP] Japan ..... 1-86502

[51] Int. Cl.[5] ..... G01R 33/18

[52] U.S. Cl. ..... 148/111; 148/121; 324/222

[58] Field of Search ..... 148/110, 111, 112, 121, 148/122; 324/222, 223

[56] References Cited

U.S. PATENT DOCUMENTS

| | | | |
|---|---|---|---|
| 3,281,678 | 10/1966 | Cilyo | 324/222 |
| 4,394,193 | 7/1983 | Gfrerer | 148/129 |
| 4,579,608 | 4/1986 | Shimizu et al. | 148/111 |
| 4,692,193 | 9/1987 | Yoshitomi et al. | 148/111 |
| 4,718,951 | 1/1988 | Schoen | 148/111 |
| 4,797,167 | 1/1989 | Nakayama et al. | 148/111 |
| 4,806,176 | 2/1989 | Harase et al. | 148/111 |
| 4,824,493 | 4/1989 | Yoshitomi et al. | 148/111 |
| 4,888,066 | 12/1989 | Yoshitomi et al. | 148/113 |
| 4,938,807 | 7/1990 | Takahashi et al. | 148/111 |

*Primary Examiner*—George Wyszomierski
*Attorney, Agent, or Firm*—Wenderoth, Lind & Ponack

[57] ABSTRACT

A method of primary recrystallization annealing grain-oriented electrical steel strip comprises the steps of conducting online measurement of the primary recrystallization grain diameter of the steel after primary recrystallization annealing and, based on the result of this measurement, controlling the primary recrystallization grain diameter of the steel after primary recrystallization annealing by varying either or both of the annealing temperature and the pass velocity during the primary recrystallization annealing. The method enables stable production of grain-oriented electrical steel strip exhibiting good secondary recrystallization and excellent electrical properties.

1 Claim, 3 Drawing Sheets

METHOD OF PRIMARY RECRYSTALLIZATION ANNEALING GRAIN-ORIENTED ELECTRICAL STEEL STRIP

This application is a continuation-in-part of application Ser. No. 07/663,205 filed Feb. 28, 1991, abandoned, which is a continuation of application Ser. No. 07/461,123 filed Jan. 4, 1990 (now abandoned).

BACKGROUND OF THE INVENTION

1. Field of the Invention

This invention relates to a method of primary recrystallization annealing of cold rolled steel strip that is raw material for grain-oriented electrical steel strip for use in power transformer cores and the like.

2. Description of the Prior Art

All grain-oriented electrical steel strip currently being used in practical applications invariably has a steep crystallographic texture formed by secondary recrystallization. This secondary recrystallization texture is controlled to have a grain orientation which ensures that when the grain-oriented electrical steel strip is used for the core of a transformer or other such electric device, the device will exhibit optimum performance and efficiency. The performance of the electric device improves in proportion with increasing steepness of the secondary recrystallization texture. Generally speaking, the steepness of the secondary recrystallization texture is strongly reflected in the magnetic flux density ($B_8$ value: degree of magnetization in an 800 AT/m magnetic field) of the grain-oriented electrical steel strip. Those concerned with the development and production of grain-oriented electrical steel strip are therefore interested more than anything else in how secondary recrystallization can be made to occur optimally in the process of manufacturing such steel strip.

Secondary recrystallization is a phenomenon involving abnormal growth of primary recrystallization grains with extremely high orientation selectivity.

It is well known that the strength of this orientation selectivity, which governs the magnetic flux density of grain-oriented electrical steel strip, is dependent on such factors as the crystallographic texture of the primary recrystallization grain structure, the average grain diameter and the inhibitor strength (the resistance to grain boundary movement imparted by precipitates and grain boundary segregation elements). Notwithstanding, no method has so far been disclosed for measuring primary factors governing the magnetic flux density of grain-oriented electrical steel strip and then using the result of the measurement for ensuring optimum formation of the primary recrystallization structure. Moreover, in the industrial production of grain-oriented electrical steel strip there is sometimes experienced large-scale occurrence of poor secondary recrystallization (to the extent that the products have to be scrapped). Although this happens only rarely, it is a very serious problem because of the manner in which grain-oriented electrical steel strip is produced. Specifically the finish annealing step of the grain-oriented electrical steel strip is a batch annealing process in which a large number of strip coils of the same type are simultaneously treated and requires between 150 and 200 hours. Therefore, when poor secondary recrystallization is discovered after finish annealing in even a small number of the strip coils, there is high probability that a high percentage of the remaining strip coils also suffer inferior secondary recrystallization. Unfortunately, it takes a long time to determine the cause of inferior secondary recrystallization and establish the required countermeasures. Once inferior secondary recrystallization arises, therefore, the scale of the loss it produces is likely to be large.

Product-to-product variation in magnetic flux density is observed even in normal grain-oriented electrical steel strip produced under ordinary conditions.

Such variation in magnetic flux density is observed not only among products from different steel lots (despite the lack of any difference in composition), but also among strip coils from the same steel lot and even among different parts of one and the same strip coil. It is thus these variations that impede the stabilization of the magnetic flux density of grain-oriented electrical steel strip at a high level. The cause lies in the fact that the secondary recrystallization behavior is highly sensitive to subtle changes in the various processing conditions involved in the production of grain-oriented electrical steel strip.

If the cause of the inferior secondary recrystallization and the variation in magnetic flux density is present at point prior to the finish annealing step, its effect can also be expected to be manifested with respect to the primary recrystallization grain diameter and other factors governing the magnetic flux density. Therefore, if it should be possible during the primary recrystallization annealing step to conduct online measurement of the primary recrystallization grain diameter and other factors governing the magnetic flux density, this would be highly effective for preventing the large-scale occurrence of poor secondary recrystallization. Moreover, if it should be further possible to eliminate the factors adversely affecting the product magnetic flux density by adjusting the primary recrystallization annealing conditions, this would make it possible to stabilize the magnetic flux density of the grain-oriented electrical steel strip at a high level.

SUMMARY OF THE INVENTION

This invention was completed on the basis of the inventors' discovery that the grain structure of the steel after primary recrystallization annealing strongly affects the occurrence in the finish annealing step of products exhibiting inferior secondary recrystallization and poor electrical properties.

An object of the invention is to provide a method of primary recrystallization annealing grain-oriented electrical steel strip enabling the occurrence of a product inferior in secondary recrystallization or electrical properties to be predicted and prevented in the course of its production.

For achieving this object, the invention provides a method of primary recrystallization annealing grain-oriented electrical steel strip comprising the steps of conducting online measurement of the primary recrystallization grain diameter of the steel after primary recrystallization annealing and, based on the result of this measurement, using the temperature-time relationship in the primary recrystallization annealing step as a parameter for controlling the primary recrystallization grain diameter to fall within an optimum range.

DETAILED DESCRIPTION OF THE PREFERRED EMBODIMENT

Figure 1:
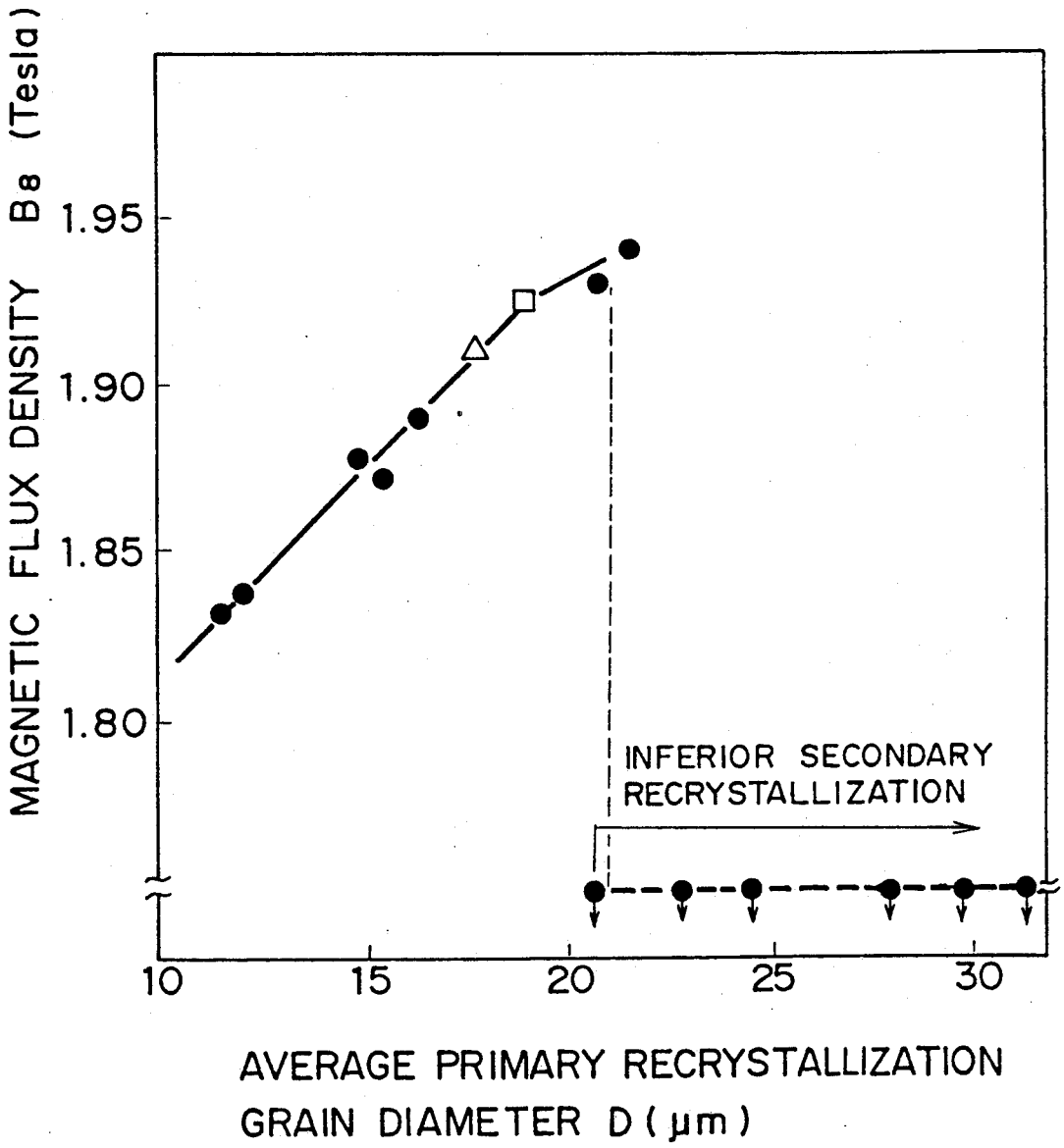
FIG. 1 is a graph showing the relationship between the average diameter D of the primary recrystallization grains of a steel after primary recrystallization annealing and the magnetic flux density ($B_8$ value) of the grain-oriented electrical steel strip product produced from the steel.

FIG. 1 shows the relationship between the average diameter D of the primary recrystallization grains of a steel after primary recrystallization annealing and the magnetic flux density ($B_8$ value) of the grain-oriented electrical steel strip product produced from the steel. The average diameter of the primary recrystallization grains is defined here as the mean value of the diameters of circles of equivalent area to the grains within a two-dimensional section.

The following is one example of the processing conditions used in the production of a grain-oriented electrical steel strip falling within the scope of this invention.

A slab consisting of, in weight-percent, 0.056% C, 3.24% Si, 0.025% acid-soluble Al, 0.0079% N, 0.006% S, 0.15% Mn and the balance of Fe and unavoidable impurities is heated to the temperature of 1150° C. and hot rolled into a 2.3 mm-thick hot-rolled strip. The hot-rolled strip is annealed at a temperature in the range of 900°-1200° C., the annealed strip is cold rolled into a 0.285 mm-thick cold-rolled strip by cold rolling including a final cold rolling step with a heavy reduction ratio of about 88%, the cold-rolled strip is annealed at a temperature in the range of 830°-1000° C., the annealed strip is coated with an annealing separation agent consisting mainly of MgO, the coated strip is coiled into a strip coil and the strip coil is then finish annealed.

As can be seen in FIG. 1, the average diameter D of the primary recrystallization grains of the steel after the primary recrystallization annealing has a very marked effect on the magnetic flux density ($B_8$ value) and the quality of the secondary recrystallization of the product.

FIG. 1 further clearly indicates that it is possible to consistently obtain products exhibiting high magnetic flux densities by controlling the average diameter D of the primary recrystallization grains of the steel after primary recrystallization annealing to fall in the range of 15-22 μm, preferably 18-20 μm. It should be understood, however, that the optimum value of the average diameter D of the primary recrystallization grains after primary recrystallization does not necessarily fall within the range of 15-22 μm, preferably 18-20 μm, for all grain-oriented electrical steel strip materials and may in some cases fall outside these ranges depending on the crystallographic texture and the inhibitor strength (heat resistance property). Nevertheless, the same tendency also applies to these exceptional cases.

In FIG. 1, the symbol Δ indicates the value in the case of a hot-rolled strip annealing temperature of 1200° C. and a primary recrystallization temperature of 950° C., while the symbol □ indicates that in the case of a hot-rolled strip annealing temperature of 1150° C. and a primary recrystallization temperature of 850° C. Thus even though the steel subjected to hot-rolled strip annealing in the 1200° C. range was primary recrystallization annealed at a temperature 100° C. higher than the steel subjected to hot-rolled strip annealing in the 1150° C. range, the grain diameter of its primary recrystallization grains was smaller than that of the steel subjected to hot-rolled strip annealing in the 1150° C. range. This is one example of how a small change in an earlier processing step can greatly alter what will be the optimum conditions in a later processing step. It is phenomena like this that are the cause for inferior secondary recrystallization and variation in magnetic flux density.

As mentioned earlier, controlling the primary recrystallization grain diameter to fall in the optimum range makes it possible to solve the problem of inferior secondary recrystallization and variation in magnetic density and also enables grain-oriented electrical steel strip exhibiting superior electrical properties to be produced stably on an industrial basis. This invention requires online measurement of the primary recrystallization grain diameter but puts no particular restriction on the means used for the online measurement. As a result of their study of various different online measurement means, however, the inventors learned that measurement based on measurement of the core loss value of the steel after primary recrystallization annealing is highly effective from the points of accuracy and adaptability to online utilization. They found this method to be fully adequate for practical application.

Figure 3:
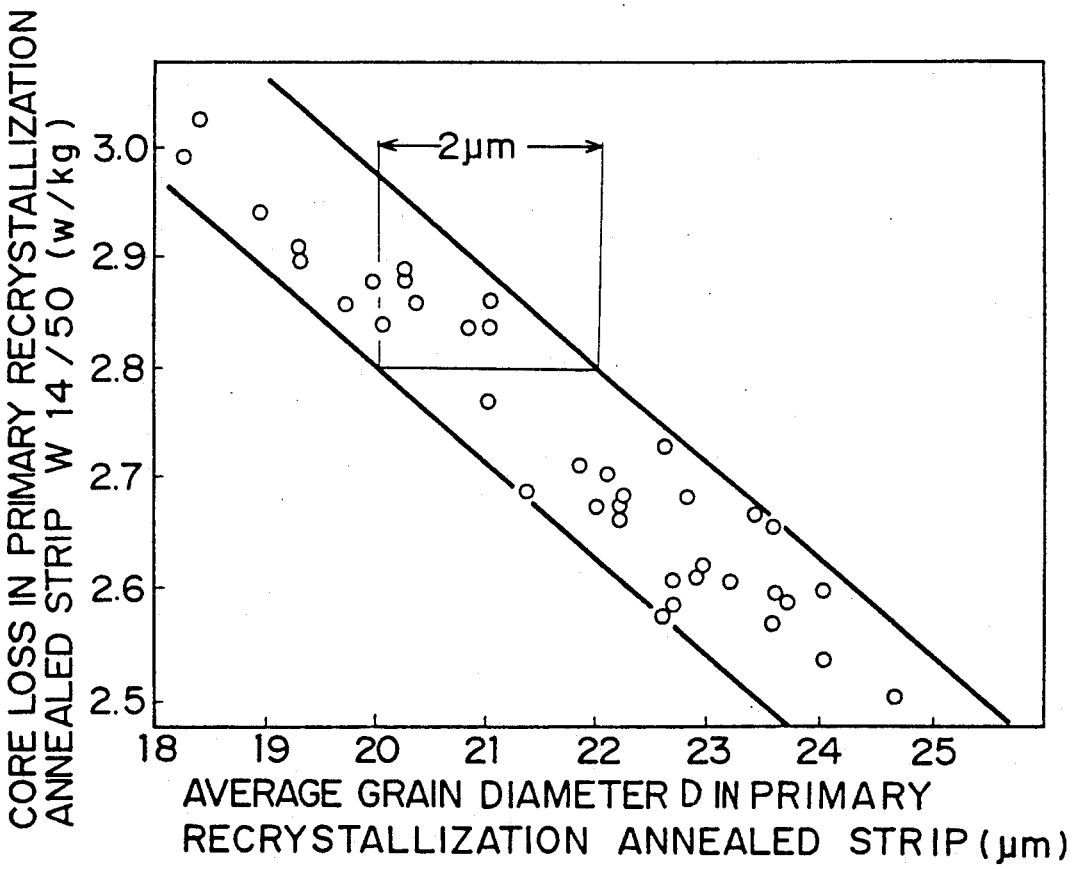
FIG. 3 is a graph showing the relationship between the average diameter D of the primary recrystallization grains and the core loss $W_{14/50}$ (W/kg) of a steel after primary recrystallization annealing.

FIG. 3 shows the relationship between the average diameter D (μm) of the primary recrystallization grains of a steel after primary recrystallization annealing and the core loss $W_{14/50}$ (W/kg) of the same steel. This relationship was obtained for products produced by preparing a slab consisting of, in weight percent, 0.05% C, 3.25% Si, 0.028% acid-soluble Al, 0.0075% N, 0.007% S, 0.14% Mn and the balance of Fe and unavoidable impurities, heating the slab to 1150° C. and hot rolling the heated slab into a 1.8 mm-thick hot-rolled strip. The so-obtained hot-rolled strip was annealed at 1150° C., pickled, and cold rolled to a thickness of 0.19 mm. The cold-rolled strip was slit into 60 mm-wide bands which were subjected to combined primary recrystallization annealing and decarburization in an atmosphere consisting of 75% $H_2$ and 25% $N_2$ and having a dew point of 55° C. at temperatures in the range of 810°-870° C. The annealing period was varied between 90 and 150 seconds by varying the pass velocity.

As can be seen from FIG. 3, there is a very good linear correlation between the average diameter D (μm) of the primary recrystallization grains and the core loss value $W_{14/50}$ (W/kg). Based on this correlation, the following formula can be used to calculate the average diameter of the primary recrystallization grains from the core loss value W (W/kg) to an accuracy of ±1 μm:

$$D = -11.17W + 52.33 \ (\mu m)$$

Considered in light of FIG. 1, this degree of accuracy is adequate for preventing the occurrence of inferior secondary recrystallization and obtaining products with high magnetic flux density.

The online measurement of the core loss value [$W_{14/50}$ (W/kg)] is conducted by disposing primary and secondary coils for core loss measurement between the primary recrystallization annealing furnace and the annealing separator agent coater and passing the steel (strip) after primary recrystallization annealing through these two coils. The average diameter D (μm) of the primary recrystallization grains of the steel after primary recrystallization annealing is then obtained from the measured core loss value using the aforesaid formula. When the average diameter D (μm) of the primary recrystallization grains of the steel after primary recrystallization annealing does not fall within the optimum range (15–22 μm) shown in FIG. 1, one or more primary recrystallization annealing conditions are used as operational parameters for controlling the average primary recrystallization grain diameter to fall within the optimum range.

Figure 2:
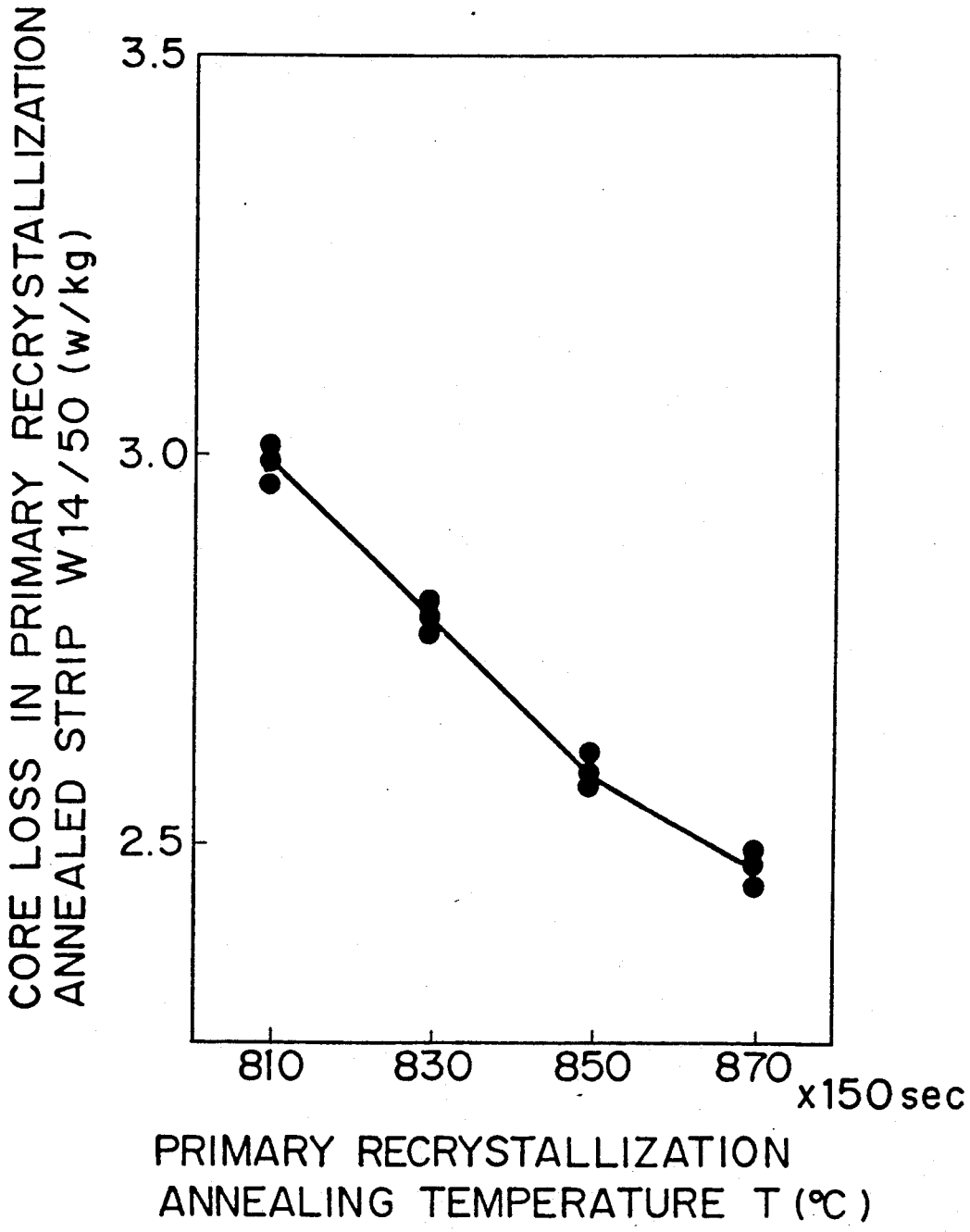
FIG. 2 is a graph showing the relationship between the primary recrystallization temperature and the core loss $W_{14/50}$ (W/kg) of a steel after primary recrystallization annealing.

One method of using a primary recrystallization annealing condition as an operational parameter for controlling the average diameter of the primary recrystallization grains is, for example, to carry out this control by varying the primary recrystallization annealing temperature. When, among the steels for which results are shown in FIG. 1, the cold-rolled strip obtained by cold rolling the hot-rolled strip annealed at 1150° C. to a thickness of 0.285 mm was thereafter subjected to combined primary recrystallization annealing and decarburization at various temperatures in a wet hydrogen atmosphere, the relationship between the annealing temperature and core loss value [$W_{14/50}$ (W/kg)] of the steel after primary recrystallization annealing was found to be as shown in FIG. 2. It can be seen from FIGS. 2 and 3 that the primary recrystallization grain diameter can be made larger by increasing the primary recrystallization annealing temperature. Moreover, even at the same temperature level, the primary recrystallization grain diameter can be made larger by prolonging the annealing period, that is by reducing the pass velocity. In an actual operation, therefore, the primary recrystallization annealing temperature and the pass velocity can be used individually or in combination as operational parameters for controlling the primary recrystallization grain diameter.

Thus, in this way the average diameter of the primary recrystallization grains of the steel after primary recrystallization annealing is controlled to fall within the optimum range of 15–22 μm, preferably 18–20 μm.

EXAMPLE

A slab consisting of, in weight-percent, 0.05% C, 3.25% Si, 0.028% acid-soluble Al, 0.0075% N, 0.007% S, 0.14% Mn and the balance of Fe and unavoidable impurities was heated to 1150° C. and hot rolled into a 1.8 mm-thick hot-rolled strip. The so-obtained hot-rolled strip was annealed at 1150° C., pickled, and cold rolled to a thickness of 0.19 mm. The cold-rolled strip was slit into 60 mm-wide bands which were subjected to combined primary recrystallization annealing and decarburization in an atmosphere consisting of 75% $H_2$ and 25% $N_2$ and having a dew point of 55° C. at temperatures in the range of 810°–870° C. The annealing period was varied between 90 and 150 seconds by varying the pass velocity. Upon exiting from the continuous annealing the strip was passed through primary and secondary coils for core loss measurement and the core loss value was measured thereby. The average diameter of the primary recrystallization grains was calculated by a computer based on the aforementioned relationship between core loss value and average primary recrystallization grain diameter. Based on the result of this calculation, the pass velocity was altered for controlling the grain diameter. As a result of this operation, the average diameter of the primary recrystallization grains of the steel after primary recrystallization annealing was controlled to within the range of 18°–20° μm. The strip was then coated with an annealing separator agent and thereafter finish annealed. The so-obtained products exhibited a high magnetic flux density ($B_8$ value) of not less than 1.92 Tesla.

When applied to the process of producing grain-oriented electrical steel strip, the invention enables the diameter of the primary recrystallization grains of the steel (strip) after primary recrystallization to be controlled by conducting online measurement of the diameter of the primary recrystallization grains of the steel after primary recrystallization annealing and then, based on the result of this measurement, varying either or both of the annealing temperature and the pass velocity during the primary recrystallization annealing. Since the primary recrystallization grain diameter strongly affects the secondary recrystallization behavior and the magnetic flux density of the product, controlling this diameter to fall within the optimum range makes it possible to prevent the occurrence of inferior secondary recrystallization and to stabilize the product magnetic flux density at a high level.

What is claimed is:

1. A method for the primary recrystallization annealing of a cold rolled steel strip that is the raw material for a grain-oriented electrical steel strip, comprising the steps of conducting online measurement of the core loss value of primary recrystallization annealed steel strip after primary recrystallization annealing and determining the primary recrystallization grain diameter of the steep strip from the measured core loss value based on the correlation, determined in advance, between the average primary recrystallization grain diameter (D) found for a primary recrystallization annealed steel strip having the same composition, thickness and production history as the aforesaid steel strip (hereinafter "same type steep strip") and the core loss value (W) of the primary recrystallization annealed same type steel strip, and based on a correlation, determined in advance, between the average primary recrystallization grain diameter (D) of the primary recrystallization annealed same type steel strip and the flux density of a grain-oriented electrical strip produced by finish annealing the primary recrystallization annealed same type steel strip, varying either or both of the annealing temperature or a pass velocity of the strip during the primary recrystallization annealing to control the determined primary recrystallization grain diameter to within an optimum range for preventing the occurrence of inferior secondary recrystallization and stabilizing the product magnetic flux at a high density.

* * * * *